US007379683B2

(12) United States Patent
Kamiya et al.

(10) Patent No.: US 7,379,683 B2
(45) Date of Patent: May 27, 2008

(54) MARK DETECTOR, DRIVE CONTROLLER, BELT DRIVE UNIT, AND IMAGE FORMING APPARATUS

(75) Inventors: Takuro Kamiya, Tokyo (JP); Koichi Kudo, Kanagawa (JP); Katsuya Kawagoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 315 days.

(21) Appl. No.: 11/269,812

(22) Filed: Nov. 9, 2005

(65) Prior Publication Data

US 2006/0116228 A1 Jun. 1, 2006

(30) Foreign Application Priority Data

Nov. 15, 2004 (JP) ..... 2004-331056

(51) Int. Cl.
*G03G 15/00* (2006.01)
*G03G 15/01* (2006.01)

(52) U.S. Cl. ..... 399/49; 399/74; 399/301

(58) Field of Classification Search ..... 399/49, 399/74, 162, 164, 167, 301–303
See application file for complete search history.

(56) References Cited

U.S. PATENT DOCUMENTS

| | | | | |
|---|---|---|---|---|
| 5,523,823 | A * | 6/1996 | Ashikaga | 399/301 |
| 6,160,978 | A | 12/2000 | Tsuruoka et al. | |
| 6,301,023 | B1 | 10/2001 | Hirai et al. | |
| 6,456,310 | B1 | 9/2002 | Wallace et al. | |
| 6,947,693 | B2 * | 9/2005 | Kamiya et al. | 399/301 |
| 7,245,863 | B2 * | 7/2007 | Kamiya | 399/301 |
| 2004/0160646 | A1 | 8/2004 | Kudo et al. | |

FOREIGN PATENT DOCUMENTS

| | | |
|---|---|---|
| JP | 5-119571 | 5/1993 |
| JP | 6-263281 | 9/1994 |
| JP | 9-114348 | 5/1997 |
| JP | 9-175687 | 7/1997 |
| JP | 11-24507 | 1/1999 |
| JP | 3107259 | 9/2000 |

OTHER PUBLICATIONS

U.S. Appl. No. 11/740,570, filed Apr. 26, 2007, Kawagoe.
European Search Report.

* cited by examiner

*Primary Examiner*—William J Royer
(74) *Attorney, Agent, or Firm*—Oblon, Spivak, McClelland, Maier & Neustadt, P.C.

(57) ABSTRACT

A mark detector optically detecting a scale having multiple marks formed successively at predetermined intervals along the moving direction of an endless belt member, and outputting an electrical signal corresponding to the presence or absence of the marks when the endless belt member moves is disclosed. The mark detector includes a light illumination part configured to illuminate the light illumination surface of the endless belt member on which surface the scale is formed with parallel light rays; a light receiving part configured to receive reflected light from the light illumination surface; and a variation prevention part configured to prevent a variation of the light illumination surface. The variation prevention part includes a holding member configured to hold the endless belt member in the vicinity of the light illumination surface movably in the moving direction from the exterior surface side and the interior surface side of the endless belt member.

10 Claims, 7 Drawing Sheets

MARK DETECTOR, DRIVE CONTROLLER, BELT DRIVE UNIT, AND IMAGE FORMING APPARATUS

BACKGROUND OF THE INVENTION

1. Field of the Invention

The present invention relates generally to mark detectors, drive controllers, belt drive units, and image forming apparatuses, and more particularly to a mark detector for appropriately rotating an endless belt member, a drive controller including the same, a belt drive unit including the drive controller and the endless belt member, and an image forming apparatus, such as a copier, a printer, or a facsimile machine, including the belt drive unit.

2. Description of the Related Art

Some electrophotographic image forming apparatuses have multiple primary transfer parts (primary transfer means) to successively transfer respective single-color images formed with corresponding single-color toners on corresponding multiple photosensitive bodies (first image carriers) onto an intermediate transfer body (second image carrier), thereby superposing the single-color images one over another so as to form a composite color image; and a secondary transfer part (secondary transfer means) to transfer the composite color image formed on the intermediate transfer body onto a sheet of paper. Other electrophotographic image forming apparatuses have a primary transfer part to successively transfer single-color images formed successively with corresponding single-color toners on a photosensitive body onto an intermediate transfer body, thereby superposing the single-color images one over another so as to form a composite color image; and a secondary transfer part to transfer the composite color image formed on the intermediate transfer body onto a sheet of paper.

In such image forming apparatuses, for example, those having endless belt members for image formation, such as a belt-like photosensitive body (photosensitive body belt), a belt-like intermediate transfer body (intermediate transfer belt), and a paper conveyor belt, it is required to control the amount of movement and the movement position of the endless belt member (actually, its moving surface) with accuracy in order to accurately position the endless belt member and an image (toner image) on a sheet of paper (transfer material) conveyed by the endless belt member.

However, the movement velocity of the endless belt member is likely to vary because of various factors such as load variations caused by a member contacting the endless belt member. Accordingly, it is extremely difficult to eliminate variations in the velocity of the endless belt member completely. Therefore, if the endless belt member is caused to vary for some reasons, its movement velocity, amount of movement, and movement position also vary. This results in a problem in that it is difficult to control error in the positions of the endless belt member and an image on a sheet of paper conveyed by the endless belt member with high accuracy.

In order to eliminate this disadvantage, an image forming apparatus is proposed in which: a rotary encoder is directly coupled to the rotary shaft of an endless drum-like member or the rotary shaft of a driving roller (for moving an endless belt member) in order to control error in the position of an image due to variations in the rotational angular velocity of the endless drum-like member or the driving roller with high accuracy; and the rotational angular velocity of a drive motor serving as means to drive the endless drum-like member or the driving roller is controlled based on the rotational angular velocity of the endless drum-like member or the driving roller detected by the rotary encoder (see, for example, Japanese Patent No. 3107259). This image forming apparatus indirectly controls the amount of movement (movement position) of the endless drum-like member or the endless belt member by controlling the rotational angular velocity of the endless drum-like member or the driving roller.

On the other hand, an image forming apparatus is proposed in which: marks (or holes) are formed on the exterior surface (top surface) or the interior surface (bottom surface) of a belt (endless belt member) so as to be successive at predetermined intervals along the moving direction of the belt; and the movement velocity of the belt surface is calculated from a pulse interval obtained by detecting the marks with a sensor (mark sensor) and is fed back to a drive control (see, for example, Japanese Laid-Open Patent Application Nos. 6-263281, 9-114348, and 11-24507). According to this image forming apparatus, it is possible to directly observe the behavior of the belt surface. Accordingly, it is possible to directly control its amount of movement. As a result, it is possible to reduce the eccentricity of a driving roller for driving the belt, skidding between the driving roller and the belt, and detection error due to the thickness deviation of the belt, thus making it possible to perform drive control with high accuracy.

In general, however, it is extremely difficult to have an endless belt member formed to be uniform in thickness in its direction of movement (rotational direction). Further, the thickness of the endless belt member varies because of deformation of the endless belt member due to tension applied thereto during its movement. Therefore, while the endless belt member is moving, a change is caused in the distance between the endless belt member (marks) and a mark sensor. Further, in the case of detecting marks in a part of the endless belt member (belt part) between multiple support members supporting the endless belt member, a change is also caused in the distance between the endless belt member and the mark sensor by the vibration of the belt part. Further, an angle (angular error) greater than a prescribed range may be formed at the time of attaching the mark sensor.

Therefore, in the case of optically detecting multiple marks on the endless belt member, that is, in the case of detecting multiple marks on the endless belt member using a light-reflection-type mark sensor having light emitting means to emit a beam (light beam) onto the light illumination surface (marks) of the endless belt member and light receiving means to receive reflected light from the light illumination surface, if a change in the distance between the mark sensor and the light illumination surface (detection distance) goes beyond a prescribed range because of the above-described thickness or vibration of the endless belt member or the attachment angle goes beyond a prescribed range at the time of attaching the mark sensor, the angle formed between the light illumination surface and the optical axis of the beam emitted from the light emitting means onto the light illumination surface goes beyond a range that does not affect image quality. This causes a problem in that timing error occurs in mark detection so as to cause detection error.

SUMMARY OF THE INVENTION

Accordingly, it is a general object of the present invention to provide a mark detector, a drive controller, a belt drive unit, and an image forming apparatus in which the above-described disadvantage is eliminated.

A more specific object of the present invention is to provide a mark detector, a drive controller, a belt drive unit, and an image forming apparatus that can appropriately control the velocity or position of an endless belt member by reducing detection error in optically detecting multiple marks on the endless belt member.

The above objects of the present invention are achieved by a mark detector optically detecting a scale having a plurality of marks formed successively at predetermined intervals along a moving direction of an endless belt member, and outputting an electrical signal corresponding to presence or absence of the marks when the endless belt member moves, the mark detector including: a light illumination part configured to illuminate a light illumination surface of the endless belt member on which surface the scale is formed with parallel light rays; a light receiving part configured to receive reflected light from the light illumination surface; and a variation prevention part configured to prevent a variation of the light illumination surface, wherein the variation prevention part includes a holding member configured to hold the endless belt member in a vicinity of the light illumination surface movably in the moving direction from an exterior surface side and an interior surface side of the endless belt member.

The above objects of the present invention are also achieved by a drive controller including a mark detector according to the present invention, wherein a drive part for rotating the endless belt member is connectable to the drive controller, and the drive controller controls a drive force of the drive part by generating a control signal based on an output of the mark detector, thereby controlling at least one of a velocity and a position of the endless belt member.

The above objects of the present invention are also achieved by a belt drive unit including a drive controller according to the present invention; an endless belt member, and a drive part.

The above objects of the present invention are also achieved by an image forming apparatus including a belt drive unit according to the present invention, wherein the endless belt member is one of a paper conveyor belt, a transfer belt, an intermediate transfer belt, and a photosensitive belt.

According to one embodiment of the present invention, a mark detector includes a variation prevention part configured to prevent variations of the light illumination surface of an endless belt member on which surface a scale is formed, and the variation prevention part includes a holding member that holds the endless belt member in the vicinity of the light illumination surface movably in its moving direction from the exterior surface side and the interior surface side of the endless belt member. This configuration makes it possible to reduce detection error in optically detecting multiple marks on the scale.

According to a drive controller according to one embodiment of the present invention, it is possible to appropriately control the velocity or position of the endless belt member based on the output of the above-described mark detector.

According to a belt drive unit according to one embodiment of the present invention, it is possible to move the endless belt member with high accuracy by the control of the above-described drive controller.

According to an image forming apparatus according to one embodiment of the present invention, by the use of the above-described belt drive unit, it is possible to perform appropriate image formation, and thus to improve image quality.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
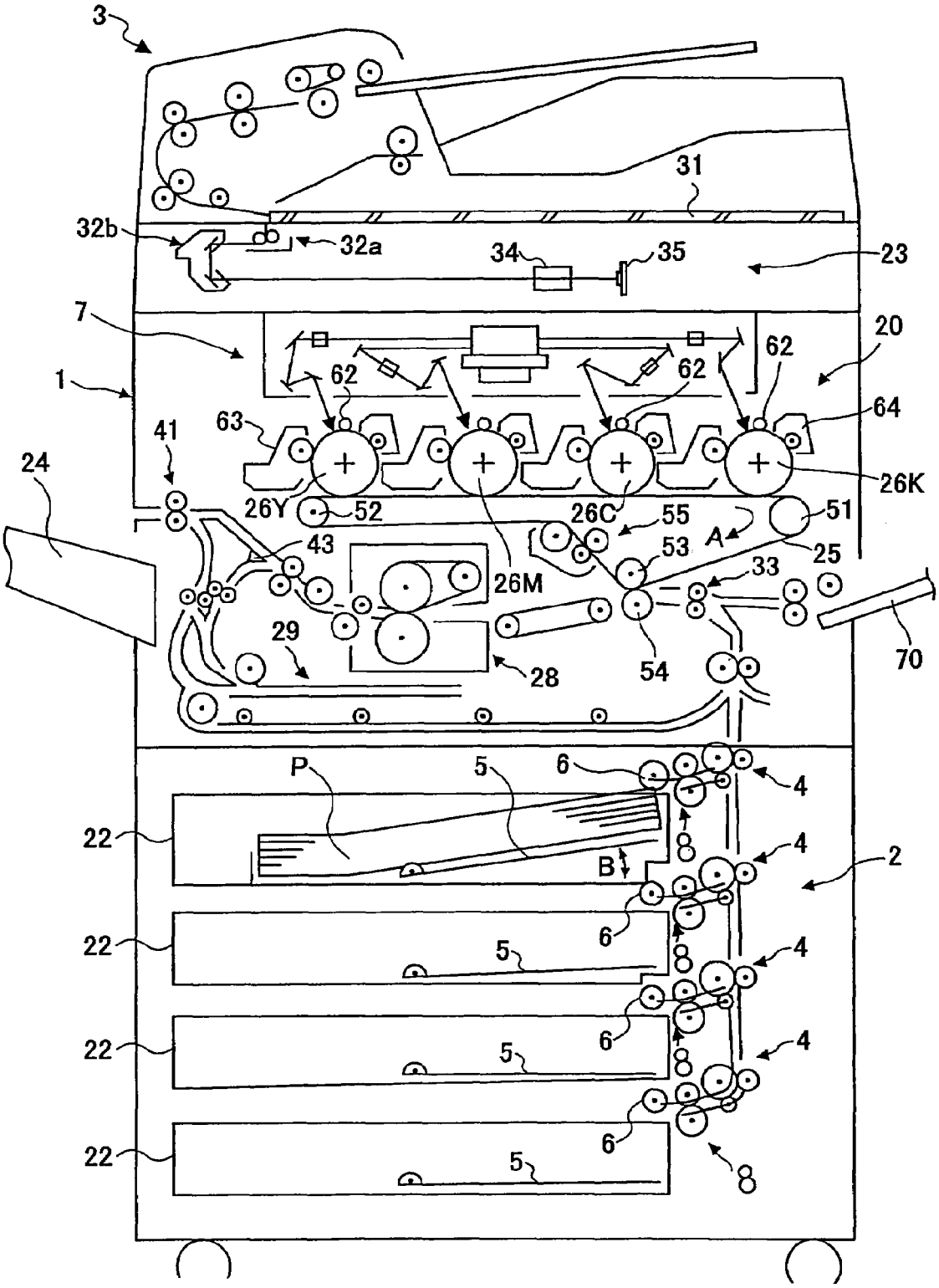
FIG. 1 is a schematic diagram showing an internal configuration of an image forming apparatus according to an embodiment of the present invention.

FIG. 1 is a schematic diagram showing an internal configuration of an image forming apparatus according to the embodiment of the present invention. The image forming apparatus according to this embodiment may be a color copier.

The color copier of FIG. 1 is a tandem indirect-transfer electrophotographic apparatus. The color copier has a paper feed bank (paper feed part) 2 disposed in the lower part of a copier main body (apparatus main body) 1. The paper feed bank 2 includes multiple (four, in this case) tiers of paper feed cassettes 22 containing sheets of paper P. The color copier has an automatic document feeder (ADF) 3 disposed in the upper part of the copier main body 1. The ADF 3 automatically feeds original material (for example, a document) onto a contact glass 31. The color copier has a printer part (image forming part) 20 disposed in the center part of the copier main body 1. Another paper feed part may be additionally provided in the paper feed bank 2 if necessary.

An operations part (not graphically illustrated) is provided in front of the ADF 3 on the upper surface of the copier main body 1. The operations part includes a start key for starting a copying operation, a numeric keypad for setting the number of copies, keys for selecting various modes including a duplex mode (a mode for forming an image on each side of a sheet of paper), paper size, and copy density, and a liquid crystal display for displaying a variety of information items. A scanner part 23 reading the image of the original material is provided on the printer part 20. A paper output tray (output paper containing part) 24 is provided on the left side of the printer part 20 in FIG. 1. Of the sheets of paper P, those on which images are formed are output onto and contained in the paper output tray 24.

The printer part 20 includes multiple drum-like photosensitive bodies (hereinafter referred to as "photosensitive drums") 26Y, 26M, 26C, and 26K (hereinafter also referred to collectively as "photosensitive drums 26"). The surface of each photosensitive drum 26 is precharged and exposed to light so that an electrostatic latent image is formed thereon. Each photosensitive drum 26 serves as a first image carrier. The printer part 20 also includes multiple development parts 63 corresponding to the photosensitive drums 26Y, 26M, 26C, and 26K. Each development part 63 develops the electrostatic latent image formed on the surface of the corresponding photosensitive drum 26 into a visible image with a corresponding color toner, thereby forming a single-color toner image (hereinafter referred to as "single-color image"). The printer part 20 further includes an intermediate transfer body (hereinafter referred to as "intermediate transfer belt") 25. The single-color images formed on the photosensitive drums 26 are successively transferred primarily onto the intermediate transfer belt 25 so that the single-color images of four colors are superposed one over another so as to form a composite color image on the intermediate transfer belt 25. Thus, the intermediate transfer belt 25 serves as a second image carrier. The intermediate transfer belt 25 rotates in the direction indicated by the arrow A in FIG. 1.

There are provided a charging part 62 and a photosensitive body cleaning part 64 around each of the photosensitive drums 26 (26Y, 26M, 26C, and 26K) shown in FIG. 1. Each charging part 62 uniformly charges the surface of the corresponding photosensitive drum 26. Each photosensitive body cleaning part 64 performs cleaning to remove and collect untransferred toner (residual toner) remaining on the corresponding photosensitive drum 26 after primary transfer of the single-color image (visible image) on the photosensitive drum 26 onto the intermediate transfer belt 25.

An exposure part 7 is provided in the upper part of the printer part 20. The exposure part 7 forms an electrostatic latent image on an exposure position (charged surface) on the corresponding photosensitive drum 26 of the printer part 20 by emitting laser light corresponding to the image information of a corresponding color onto the exposure position.

Further, in the printer part 20, registration rollers 33 forming a registration part are provided on the upstream side in the paper conveying direction, and a fixation part 28 is provided on the downstream side in the paper conveying direction. The skew of a sheet of paper P is corrected with the registration rollers 33, and the sheet of paper P is fed to a secondary transfer part between the intermediate transfer belt 25 and a secondary transfer opposing roller 54 in timing with the toner images on the photosensitive drums 26. In the secondary transfer part, the composite color image carried on the intermediate transfer belt 25 is transferred secondarily onto the sheet of paper P, which is fed from one of the paper feed cassettes 22 in the paper feed bank 2 or a manual paper feed tray 70. In the fixation part 28, the composite color image is fixed by applying heat and pressure. Paper output rollers 41 outputting the sheet of paper P passing through the fixation part 28 onto the paper output tray 24 are provided on the downstream side of the fixation part 28.

At the time of making a copy using this color copier, a user may set original material on the original material table of the ADF 3. Alternatively, the user may open the ADF 3, set the original material on the contact glass 31 of the scanner part 23, and close the ADF 3 to hold the set original material.

When the user presses the start key on the operations part, the color copier operates as follows.

That is, first, when the original material is set on the original material table of the ADF 3, the scanner part 23 is driven so that a first running body 32*a* and a second running body 32*b* are moved back and forth sideways in FIG. 1 after the set original material is fed onto the contact glass 31. On the other hand, when the original material is set directly on the contact glass 31, the scanner part 23 is immediately driven so that the first and second running bodies 32*a* and 32*b* are moved back and forth sideways in FIG. 1.

The first running body 32*a* has a light source for illuminating the original material. The light source lights up to emit light onto a surface of the original material on which an image is formed. Then, the light reflected from the original material is further reflected by the first running body 32*a* so as to be directed toward the second running body 32*b*. Then, the light is reflected by mirrors of the second running body 32*b* so as to enter a CCD (reading sensor) 35 through an imaging lens 34. Thereby, the image of the original material is read. At this point, photoelectric conversion is performed for color separation light of each of R (red), C (green), and B (blue), so that electric R, G, and B image signals are output. The R, G, and B image signals are converted into digital signals and subjected to image processing, and are fed to the exposure part 7 as image signals of yellow (Y), magenta (M), cyan (C), and black (K). The laser diodes inside the exposure part 7 are driven according to a modulation method such as PM (phase modulation) or PWM (pulse width modulation) so as to emit laser light (laser beams) corresponding to the image of the original material. The charged surface of each photosensitive drum 26 (charged by the corresponding charging part 62) is exposed to the laser light through a polygon mirror and a lens (not graphically illustrated), so that an electrostatic latent image is formed on the charged surface.

Further, by pressing the start key, a driving roller 51 is rotationally driven by a drive motor 120 (FIG. 3) so as to rotate other driven rollers 52 and 53, thereby rotating the intermediate transfer belt 25. Simultaneously, the photosensitive drums 26Y, 26M, 26C, and 26K are rotated in the printer part 20 so that single-color toners of Y, M, C, and K are adhered to the electrostatic latent images on the corresponding photosensitive drums 26Y, 26M, 26C, and 26K by the corresponding development parts 63, thereby forming toner images of the respective single colors (single-color images).

With the rotation of the intermediate transfer belt 25, the single-color images are successively transferred onto the intermediate transfer belt 25, so that a composite color image of four-color superposition is formed.

Figure 2:
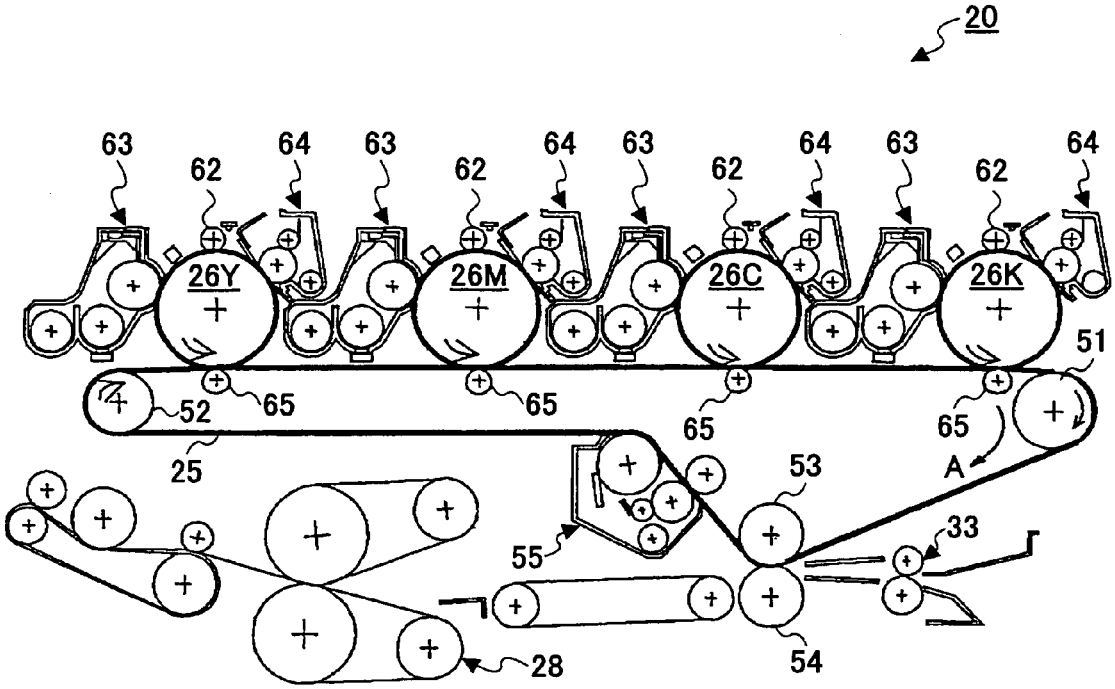
FIG. 2 is a diagram showing a detailed configuration of a printer part shown in FIG. 1 according to the embodiment of the present invention.

That is, first, primary transfer of a Y (yellow) image on the photosensitive drum 26Y onto the intermediate transfer belt 25, rotating in the direction indicated by the arrow A in FIG. 1, is performed with a corresponding one of primary transfer rollers 65 (FIG. 2). Next, when the Y image moves to the position of the photosensitive drum 26M, primary transfer of an M (magenta) image onto the intermediate transfer belt 25 is performed with a corresponding one of the primary transfer rollers 65 so that the M image is superposed on the Y image. When the part of the intermediate transfer belt 25 onto which the M image is transferred moves to the position of the photosensitive drum 26C, primary transfer of a C (cyan) image onto the intermediate transfer belt 25 is performed with a corresponding one of the primary transfer rollers 65 so that the C image is superposed on the Y and M images. When the part of the intermediate transfer belt 25 onto which the C image is transferred moves to the position of the photosensitive drum 26K, primary transfer of a K (black) image onto the intermediate transfer belt 25 is performed with a corresponding one of the primary transfer rollers 65 so that the K image is superposed on the Y, M, and C images.

When the intermediate transfer belt 25 rotates to bring a composite color image of superposition of the four colors of Y, M, C, and K to a secondary transfer position between a secondary transfer roller 53 positioned inside the intermediate transfer belt 25 and the secondary transfer opposing roller 54 positioned outside the intermediate transfer belt 25, the composite color image is transferred at a time onto a first side of a sheet of paper (recording paper) P with the secondary transfer roller 53, the sheet of paper P being fed in synchronization with the timing of movement of the composite color image to the secondary transfer position.

Thus, in this color copier, the intermediate transfer belt 25 makes one rotation so as to perform an image forming process forming one composite color image.

After the composite color image of four-color superposition is transferred onto the intermediate transfer belt 25 at a time, untransferred toner remaining on the intermediate transfer belt 25 is removed and collected by an intermediate transfer cleaning part (belt cleaning part) 55.

The sheet of paper P passing through the fixation part 28 with the composite color image being fixed thereon is output onto the paper output tray 24 by the paper output rollers 41 if a simplex mode (a mode for forming an image on only one side of a sheet of paper) is set.

If the duplex mode is set, a branch claw 43 provided on the conveyance path between the fixation part 28 and the paper output rollers 41 causes the sheet of paper P to be fed into a duplex part 29 provided below the printer part 20. The sheet of paper P is turned upside down in the duplex part 29 so as to be conveyed again to the registration rollers 33. This time, a composite color image is formed on the other side (second side) of the sheet of paper P, and thereafter, the sheet of paper P is output onto the paper output tray 24 by the paper output rollers 41.

In the paper feed bank 2 feeding paper, a paper feed part 4 is provided for each paper feed tier.

The paper feed part 4 of each paper feed tier includes a bottom plate 5 on which the sheets of paper P are stacked, a pickup roller 6 rotating counterclockwise in FIG. 1 so as to feed the sheets of paper P stacked on the bottom plate 5, and a separation part 8 formed of a feed roller and a reverse roller so as to separate the sheets of paper P fed from the pickup roller 6 into individual sheets if two or more sheets of paper P are fed from the pickup roller 6.

Paper feeding from each paper feed part 4 is performed as follows. The bottom plate 5 of the paper feed cassette 22 rotates upward to a position where the uppermost one of the unused sheets of paper P contained on the bottom plate 5 comes into contact with the pickup roller 6. In this state, the pickup roller 6 rotates so that the sheets of paper P are fed from the paper feed cassette 22.

Therefore, if two or more sheets of paper P are fed, the sheets of paper P are separated into individual sheets of paper by the separation part 8. Each separated sheet of paper P is conveyed to the registration rollers 33 in a stationary state. The sheet of paper P is temporarily stopped there. The sheet of paper P is conveyed toward the printer part 20 when the registration rollers 33 start rotating with timing such that the position of the leading edge of the sheet of paper P coincides with the position of the composite color image on the intermediate transfer belt 25 with accuracy. Thereafter, image formation is performed through the above-described process, and the sheet of paper P is output onto the paper output tray 24.

Thus, this color copier is a multifunctional image forming apparatus including the function of a facsimile machine that has the image information of an original material transmitted to and/or received from a remote place under the control of a control part (not graphically illustrated) and the function of a printer that prints image information processed by a computer on a sheet of paper, in addition to the function of a digital copier that scans the original material to read its image and forms the image on a sheet of paper by digitizing the image information. Each image formed by using any of the functions is output onto the same paper output tray 24.

Next, a detailed description is given, with reference to FIG. 2, of the printer part 20.

FIG. 2 is a diagram showing a detailed configuration of the printer part 20.

As described above, the printer part 20 is a tandem image formation part where the charging part 62, the development part 63, the primary transfer roller (primary transfer part) 65, and the photosensitive body cleaning part 64 are provided around each photosensitive drum 26. According to the printer part 20, in order to form a full-color image, each photosensitive drum 26 has an electrostatic latent image of a corresponding color formed thereon, and the electrostatic latent image is developed into a toner image with a corresponding color toner. The toner images of the respective colors are successively transferred primarily onto the intermediate transfer belt 25 with the corresponding primary transfer rollers 65. As a result, a composite color image of four-color superposition is formed on the intermediate transfer belt 25.

Each charging part 62 is a roller-like contact charging member (charging roller). Each charging part 62 comes into contact with the corresponding photosensitive drum 26 so as to apply voltage thereto, thereby uniformly charging the surface of the photosensitive drum 26. Charging may also be performed with non-roller-like contact charging members or non-contact scorotron chargers.

Each development part 63 may use a monocomponent developer. In the case of FIG. 2, however, a two-component developer including a magnetic carrier and a non-magnetic toner is used. Each development part 63 includes a mixer part and a development part. The mixer part conveys the two-component developer while mixing it, and supplies and attaches the two-component developer to a corresponding development sleeve. The development part transfers the toner of the two-component developer adhered to the development sleeve onto the corresponding photosensitive drum 26. The mixer part is positioned lower than the development part.

Each primary transfer roller 65 is a roller-like contact transfer member. Each primary transfer roller 65 performs primary transfer of a single-color image on the corresponding photosensitive drum 26 onto the intermediate transfer belt 25. Primary transfer may also be performed with non-roller-like contact transfer members or non-contact scorotron chargers.

Each photosensitive body cleaning part 64 removes and collects untransferred toner remaining on the corresponding photosensitive drum 26.

The intermediate transfer belt 25 is provided to engage the driving roller 51, the driven roller 52, and the secondary transfer roller 53 so as to be rotatable in the A direction.

The intermediate transfer cleaning part 55 is provided on the surface of the part of the intermediate transfer belt 25 between the driven roller 52 and the secondary transfer roller 53.

The secondary transfer roller 53, which is a roller-like contact transfer member forming the secondary transfer part together with the secondary transfer opposing roller 54, transfers a composite color image formed on the intermediate transfer belt 25 onto a sheet of paper P. Secondary transfer may also be performed with a non-roller-like contact transfer member or a non-contact scorotron charger.

The intermediate transfer cleaning part 55 removes and collects untransferred toner remaining on the surface of the intermediate transfer belt 25 after image transfer by the intermediate transfer belt 25.

A high-voltage power supply part (not graphically illustrated) is connected to each of the primary transfer rollers 65, the secondary transfer roller 53, and the intermediate transfer cleaning part 55. The high-voltage power supply part performs a primary transfer process to apply a predetermined bias voltage to each primary transfer roller 65 in order to perform primary transfer of a single-color image formed on each photosensitive drum 26 onto the intermediate transfer belt 25. Further, the high-voltage power supply part performs a secondary transfer process to apply a predetermined bias voltage to the secondary transfer roller 53 in order to perform secondary transfer of a composite color image formed on the intermediate transfer belt 25 onto a sheet of paper P. The high-voltage power supply part also applies a predetermined bias voltage to the intermediate transfer cleaning part 55 in order to remove untransferred toner remaining on the intermediate transfer belt 25.

Next, a further description is given, with reference to FIGS. 3 through 10, of this embodiment.

Figure 3:
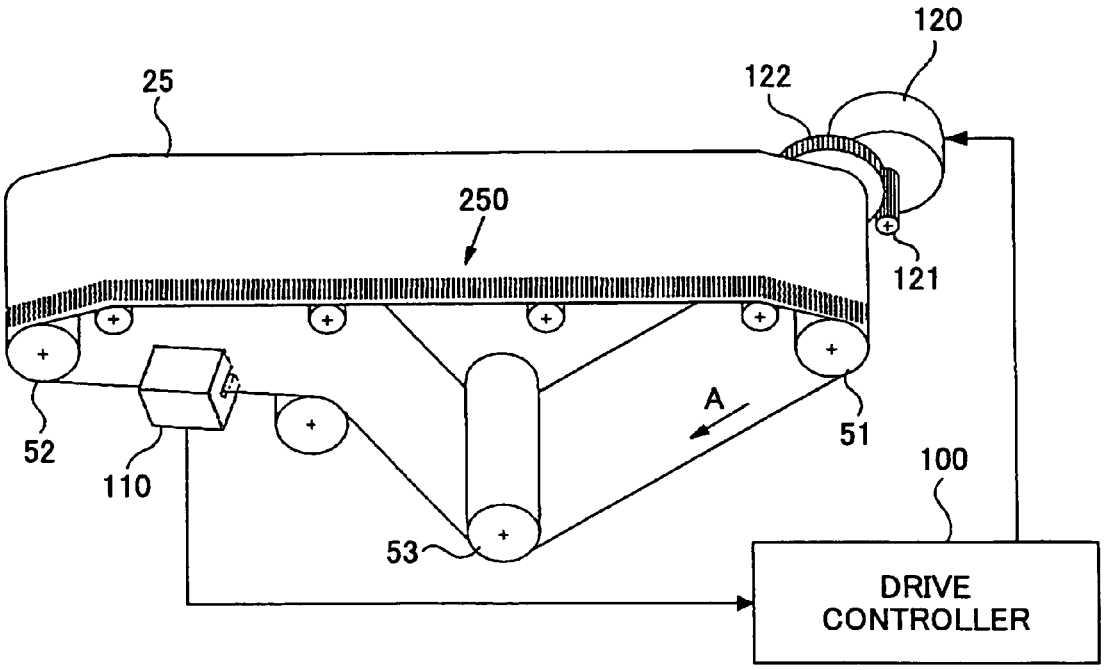
FIG. 3 is a diagram showing a belt drive unit forming an intermediate transfer belt and drive and control systems around the intermediate transfer belt shown in FIG. 2 according to the embodiment of the present invention.

FIG. 3 is a diagram showing a belt drive unit forming the intermediate transfer belt 25 and a drive system and a control system around the intermediate transfer belt 25 shown in FIG. 2.

The belt drive unit includes a scale 250 formed on the exterior surface of the intermediate transfer belt 25, which is an endless belt member (endless moving member). The scale 250 includes multiple marks (reflection parts) formed on the exterior surface of the intermediate transfer belt 25 so as to be successive at predetermined intervals (equal intervals) along the rotational direction (moving direction) of the intermediate transfer belt 25.

A drive controller 100 employs a mircrocomputer (CPU). The drive controller 100 generates a control signal based on a binary signal (electrical signal) that is the output signal of a mark sensor 110 detecting the marks on the scale 250, and controls the driving force of the drive motor 120, gears 121 and 122, and the driving roller 51 with the control signal, thereby controlling the velocity or position of the intermediate transfer belt 25. That is, the drive controller 100 calculates the velocity (movement velocity) of the exterior surface of the intermediate transfer belt 25 from the above-described binary signal, generates a corresponding control signal by feeding back the calculation result to control, and outputs the control signal to the drive motor 120 so as to drive and control the drive motor 120. Thereby, the drive controller 100 controls the velocity or position of the exterior surface of the intermediate transfer belt 25 to an optimal value through the gears 121 and 122 and the driving roller 51.

The drive motor 120, the gears 121 and 122, and the driving roller 51 correspond to a drive part configured to rotate (endlessly move) the intermediate transfer belt 25.

The mark sensor 110, which is an optical sensor, may form the entire part of a mark detector or a part thereof (for example, a combination of a light emitting element and a light receiving element) In this embodiment, the mark sensor 110 forms the entire mark detector. Further, as long as the mark sensor 110 is connected to the drive controller 100, the mark sensor 110 may be part of the drive controller 100 or provided separately from the drive controller 100.

Figure 4A:
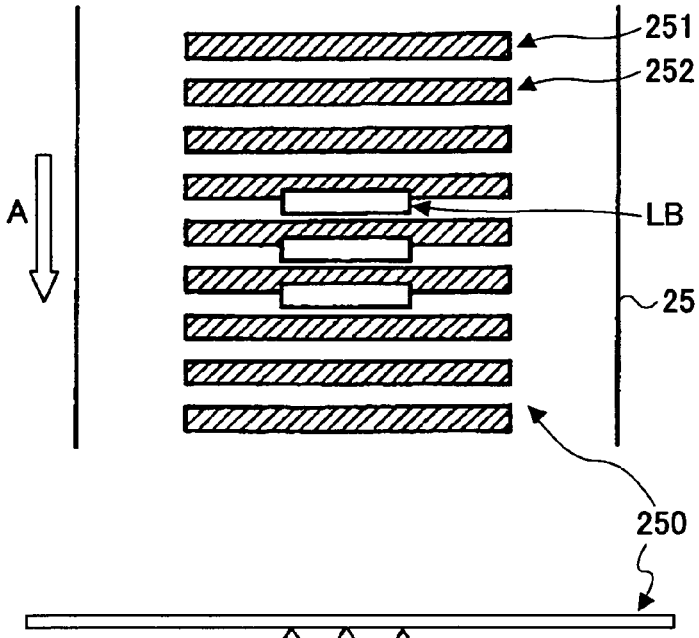
FIGS. 4A through 4C are diagrams showing a scale provided on the exterior surface of the intermediate transfer belt and a mark sensor shown in FIG. 3 according to the embodiment of the present invention.
Figure 4B:
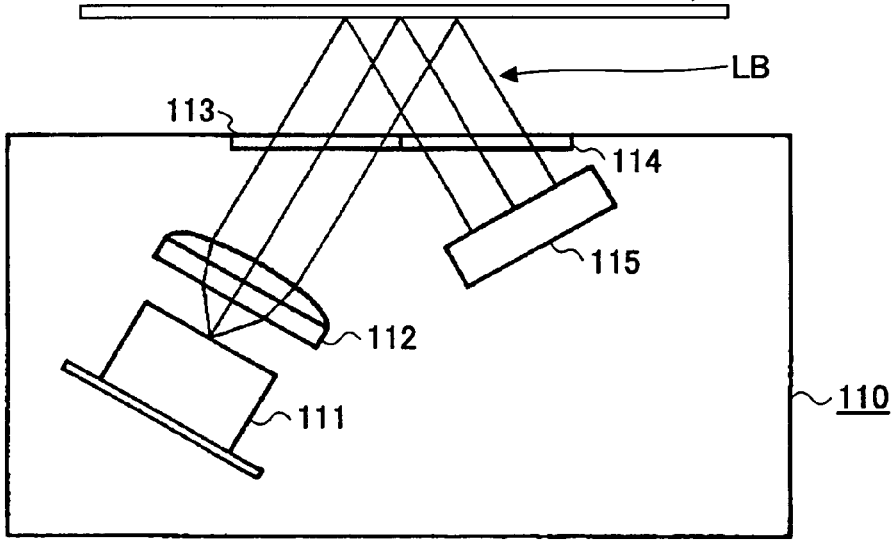
Figure 4C:
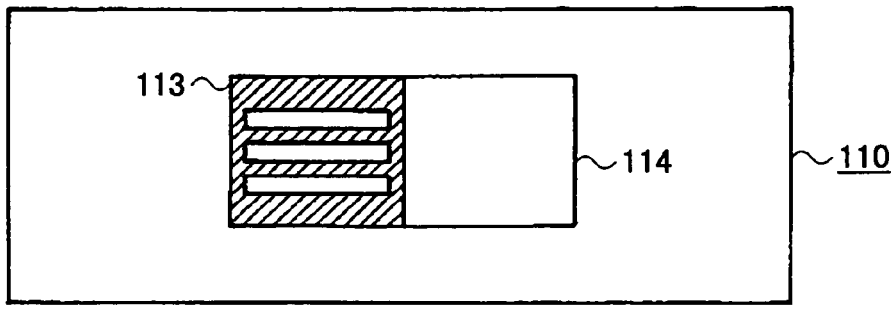
Figure 6:
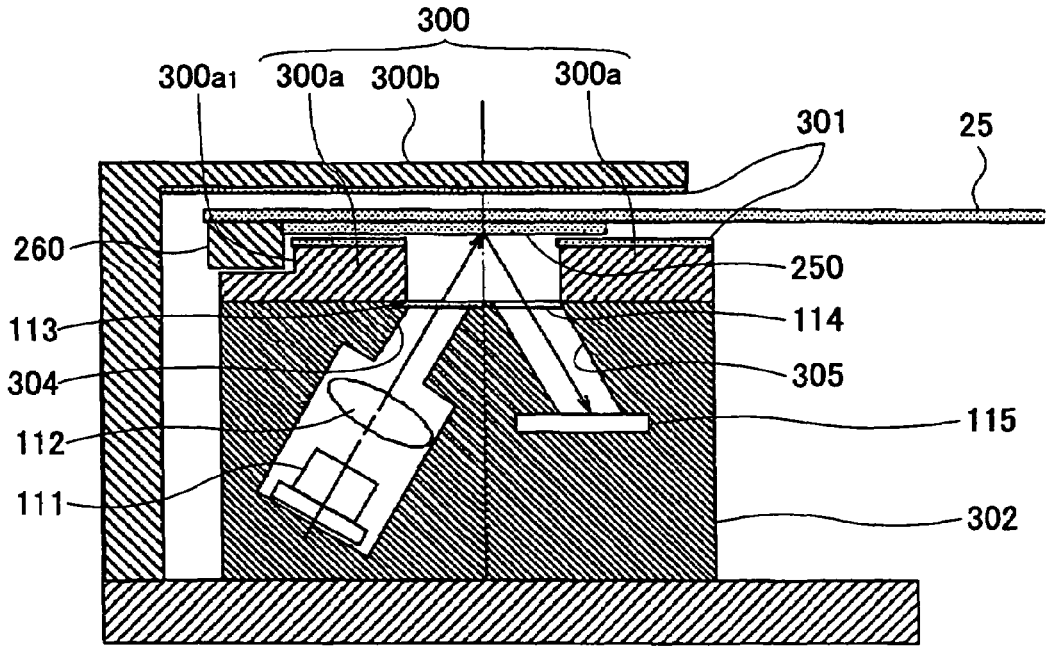
FIG. 6 is a cross-sectional view of the mark sensor of FIG. 5 taken along the line B-B according to the embodiment of the present invention.

FIGS. 4A through 4C are diagrams showing a configuration of the scale 250 provided on the exterior surface of the intermediate transfer belt 25 and a configuration of the mark sensor 110. FIG. 4 A is a plan view of part of the exterior surface of the scale 250. FIG. 4B is a diagram showing part of the mark sensor 110 for illustrating its optical system and the optical path thereof. FIG. 4C is a top plan view of the part of the mark sensor 110 of FIG. 4B (viewed from its slit surface side). In FIG. 4A, for convenience of graphical representation, the width of the scale 250 (a dimension in a direction perpendicular to the rotational direction A of the intermediate transfer belt 25 ) is shown greater than it practically is. Further, the scale 250 is provided on one side of the intermediate transfer belt 25 in its width directions together with an on-belt guide 260 (FIG. 6 ).

Referring to FIG. 4A, the scale 250 is a reflective scale having reflection parts (marks) 251 shown by hatching and light blocking parts 252 formed alternately with each other on the intermediate transfer belt 25 along its rotational direction A. That is, the scale 250 has the reflection parts 251 successively formed at predetermined intervals. For example, a material of high reflectivity, such as aluminum, is used for the reflection parts 251.

Referring to FIGS. 4B and 4C, the mark sensor 110 includes a light emitting element 111 such as an LED, a collimator lens 112, a slit mask 113, glass 114 (replaceable with a transparent cover of, for example, a transparent resin film), and a light receiving element (light receiving part) 115 such as a phototransistor.

In the mark sensor 110, a beam (light beam) emitted from the light emitting element (light source) 111 is converted into collimated light (parallel light rays) by the collimator lens 112, and is divided into multiple (three in this case) beams LB through the slit mask (a sensor slit member) 113 including multiple slits parallel to the scale 250. Each beam LB has the same width (a dimension in the moving direction A of the reflection parts 251 ) as each reflection part 251. The multiple beams LB are incident on part of the exterior surface of the intermediate transfer belt 25 on which part the scale 250 is formed. This part may be referred to as the "light illumination surface (surface to be illuminated with light)" of the intermediate transfer belt 25. Each incident beam LB is reflected from the light illumination surface if it is incident on one of the reflection parts 251. The light emitting element 111, together with the collimator lens 112, performs the function of a light illumination part illuminating the light illumination surface with light.

The reflected light of the multiple divided beams LB from the corresponding reflection parts 251 of the scale 250 of the intermediate transfer belt 25 passes through the glass 114 of the mark sensor 110 so as to be received by the light receiving element 115, where changes in the brightness of the reflected light are converted into an electrical signal.

Therefore, by detecting the reflection parts (marks) 251 of the scale 250 by receiving reflected light, the light receiving element 115 of the mark sensor 110 can output an analog alternating signal (analog signal) corresponding to the presence or absence of the reflection parts 251, that is, an analog alternating signal modulated continuously based on the presence or absence of the reflection parts 251, when the intermediate transfer belt 25 rotates (moves).

At this point, the slit mask 113 and the glass 114 positioned in the beam optical path on the surface of the mark sensor 110 serve as a mark detection area (the detection area of an optical sensor). Further, it may be suitable to employ an optical slit of a photographic emulsion type as the slit mask 113.

The analog alternating signal corresponds to an electrical signal in which a sinusoidal alternating current signal is superposed on a direct current component (may vary slightly because of variations in reflectivity or transmittance, or variations in detection distance).

This analog alternating signal is output to a binarizing circuit (not graphically illustrated).

The binarizing circuit converts the output signal (analog alternating signal) of the light receiving element 115 into a binary signal (digital signal), and outputs the binary signal to the drive controller 100 (FIG. 3) as a mark signal.

Next, a more detailed description is given, with reference to FIGS. 5 through 9C, of the configuration of the mark sensor 110.

Figure 5:
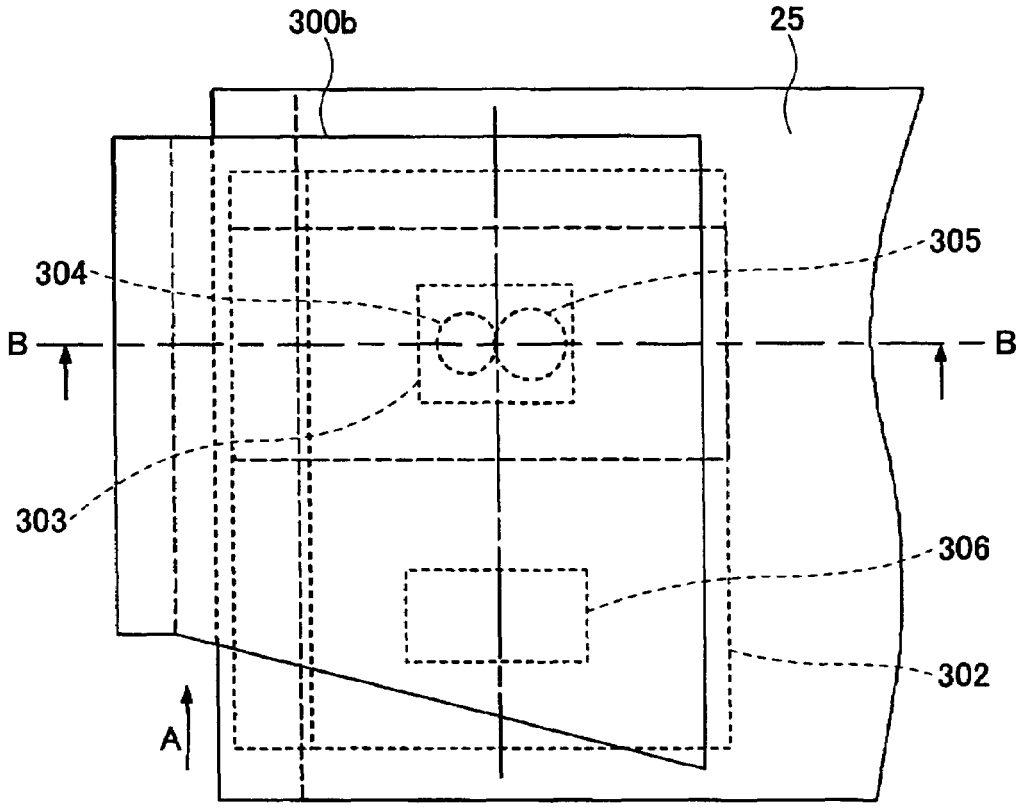
FIG. 5 is a top plan view of the mark sensor according to the embodiment of the present invention.

FIG. 5 is a top plan view of the mark sensor 110. FIG. 6 is a cross-sectional view of the mark sensor 110 of FIG. 5 taken along the line B-B.

The mark sensor 110 includes a variation prevention part configured to prevent variations of the light illumination surface of the intermediate transfer belt 25 on which surface the scale (main scale) 250 is formed (hereinafter also referred to simply as "light illumination surface").

The variation prevention part includes a holding member 300 that holds the intermediate transfer belt 25 in the vicinity of the light illumination surface movably in the moving direction (rotational direction) A from the exterior surface side and the interior surface side of the intermediate transfer belt 25. That is, the holding member 300 holds the intermediate transfer belt 25 in the vicinity of the light illumination surface from its exterior surface side and interior surface side in such a manner as to allow the intermediate transfer belt 25 to move in the moving direction A.

The holding member 300 includes a lower holding member (first holding member) 300*a* and an upper holding member (second holding member) 300*b*. The lower holding member 300*a* holds the surface of the intermediate transfer belt 25 on which the scale 250 is provided, or the exterior surface of the intermediate transfer belt 25. The upper holding member 300*b* holds the surface of the intermediate transfer belt 25 on which the scale 250 is not provided, or the interior surface of the intermediate transfer belt 25.

For convenience of graphical representation, in FIG. 6, the distance between the interior surface of the intermediate transfer belt 25 and the lower surface of the upper holding member 300*b* is shown greater than it practically is.

A cutout part $\mathbf{300}a_1$ is formed in the lower holding member 300*a*. The cutout part $\mathbf{300}a_1$ receives the on-belt guide 260 provided together with the scale 250 on one side of the exterior surface of the intermediate transfer belt 25 in its width directions (directions perpendicular to the moving direction A) so as to prevent the position of the mark sensor 110 from shifting in the above-described width directions when the intermediate transfer belt 25 rotates.

Further, the holding member 300 has short fibers (a brush, in this case) 301 provided on each of a surface thereof opposing the exterior surface of the intermediate transfer belt 25 (that is, the upper surface of the lower holding member 300*a*) and a surface thereof opposing the interior surface of the intermediate transfer belt 25 (that is, the lower surface of the upper holding member 300*b*).

The light emitting element 111 and the collimator lens 112 forming the light illumination part and the light receiving element 115 forming the light receiving part are contained in a housing 302 of the mark sensor 110 (hereinafter referred to as "sensor housing 302"). The sensor housing 302 has a sensor window 303 formed thereon. A first opening part 304 for illuminating the light illumination surface through the collimator lens 112 with a beam emitted from the light emitting element 111 and a second opening part 305 for the light receiving element 115 receiving reflected light from the light illumination surface are formed in the sensor window 303 by processing. The lower holding member 300*a* is provided, without closing the first and second opening parts 304 and 305, on the surface of the sensor housing 302 on which surface the first and second opening parts 304 and 305 are formed in the housing.

The second opening part 305 has a larger opening area than the first opening part 304.

Figure 7:
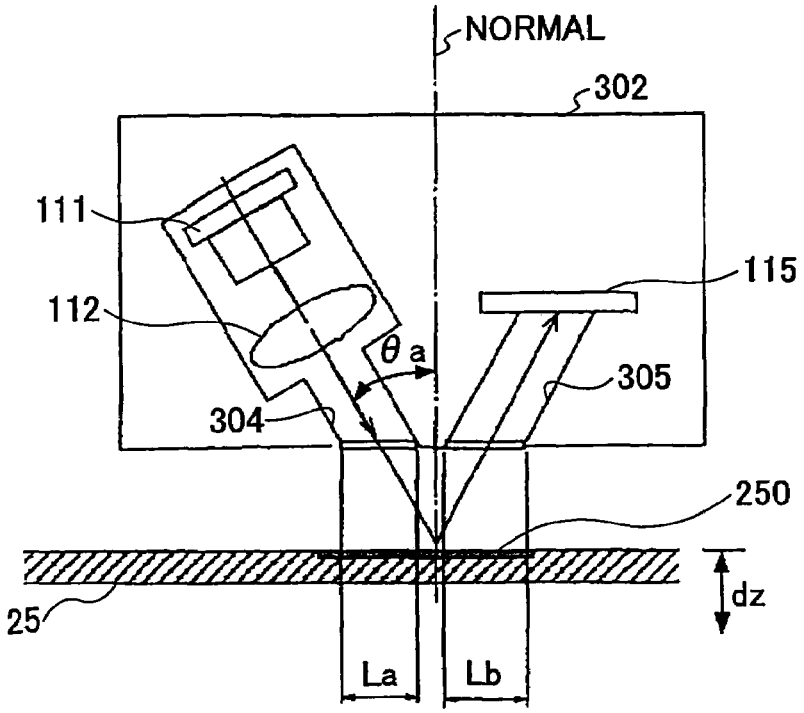
FIG. 7 is a diagram for illustrating the relationship between the opening areas of first and second opening parts shown in FIG. 5 according to the embodiment of the present invention.

FIG. 7 is a diagram for illustrating the relationship between the opening areas of the first and second opening parts 304 and 305. For convenience of description, in FIG. 7, the sensor housing 302 and the intermediate transfer belt 25 are shown upside down compared with FIG. 6. The same holds true for FIGS. 8A and 8B.

A position change Erx of reflected light (a received light beam) with respect to a variation dz (FIG. 7) of the intermediate transfer belt 25 in a normal direction is given by the following equation:

$$Erx=2\cdot dz\cdot\tan\theta a, \tag{1}$$

where θa is the angle between the optical axis of a beam emitted from the light emitting element 111 onto the light illumination surface through the collimator lens 112 and a normal from the light emission point.

Accordingly, in order to be able to receive the entire reflected light from the light illumination surface by the light receiving element 115, the following condition should be satisfied:

$$|Erx| < (Lb - La)/2 = |2\cdot dz\cdot\tan\theta a| < (Lb - La)/2, \tag{2}$$

where La is the diameter (proportional to area) of the first opening part 304, and Lb is the diameter of the second opening part 305.

In this mark sensor 110, the sensor housing 302 and the lower holding member 300*a* are disposed below the exterior surface of the intermediate transfer belt 25 on which the scale 250 is formed. Therefore, the lower holding member 300*a* is configured to be longer than the sensor housing 302 in the moving direction A with the part of the lower holding member 300*a* which part is not in contact with the sensor housing 302 being positioned on the upstream side of the sensor housing 302 in the moving direction A of the intermediate transfer belt 25. A toner trap 306 (FIG. 5) serving as an opening part for cleaning is formed in the non-contact part of the lower holding member 300*a*. If there is toner or dust adhering to the scale 250, the toner or dust is removed from the scale 250 by the short fibers 301 of the lower holding member 300*a* before the toner or dust reaches the beam illustration position, and falls down through the toner trap 306.

The slit mask 113 having multiple slits for shaping a beam passing through the collimator lens 112 so that the beam has the same width as each reflection part (mark) 251 and illuminating the light illumination surface with the shaped beam is provided in the first opening part 304. The glass 114 is provided in the second opening part 305.

Figure 8A:
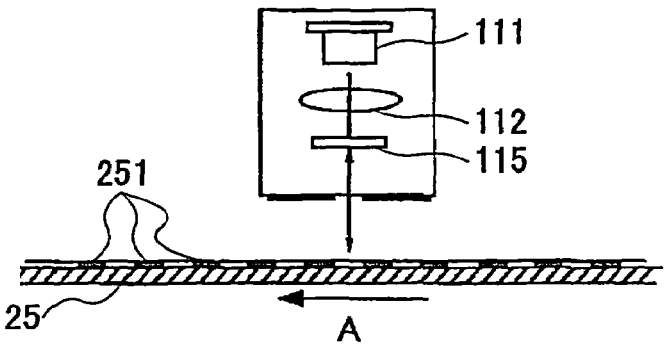
FIGS. 8A and 8B are diagrams for illustrating the arrangement of a light emitting element and a light receiving element shown in FIG. 6 according to the embodiment of the present invention.
Figure 8B:
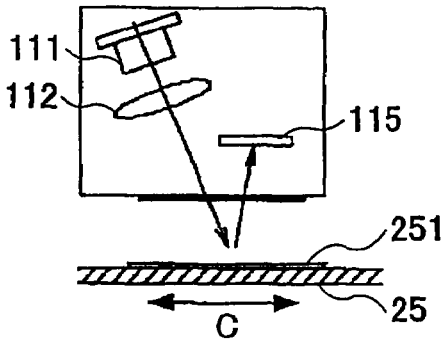

For example, as shown in FIGS. 8A and 8B, the light emitting element 111 and the light receiving element 115 are arranged side by side in the width directions C of the intermediate transfer belt 25 perpendicular to the moving direction A thereof.

Figure 9A:
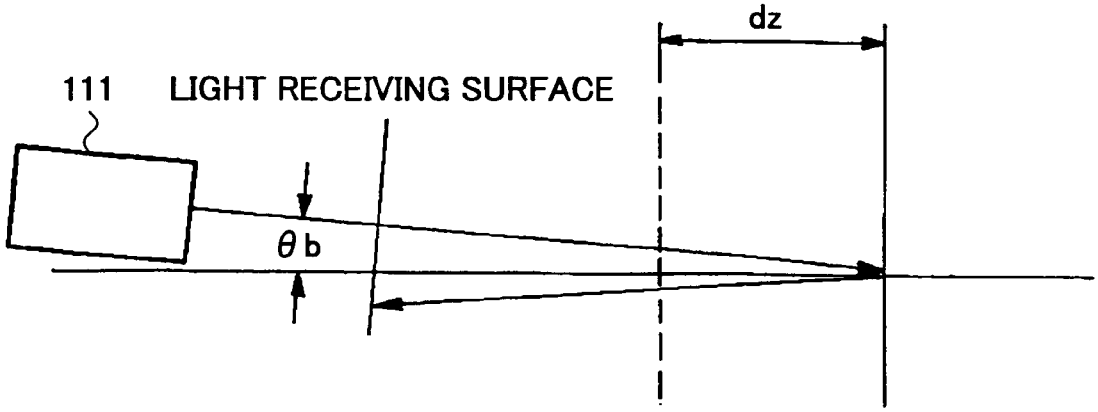
FIGS. 9A through 9C are diagrams for illustrating mark detection error with respect to a variation of the intermediate transfer belt in a normal direction in the case where the mark sensor has an attachment angle error according to the embodiment of the present invention.
Figure 9B:
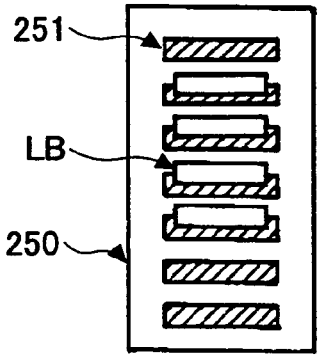
Figure 9C:
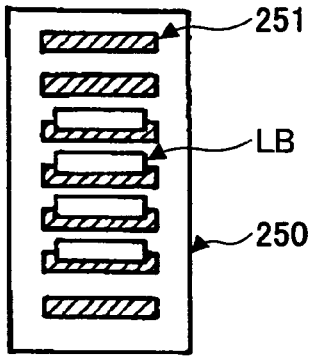

Further, for example, as shown in FIG. 9A, if the mark sensor 110 has an attachment angle error θb in the moving direction A, the illumination position of each beam LB deviates by Err (mark detection error) in the moving direction A with respect to the variation dz of the intermediate transfer belt 25 in the normal direction. For example, if the position of the intermediate transfer belt 25 changes by the variation dz, the illumination position of each beam LB (projection pattern) deviates by one mark 251 as shown in FIGS. 9B and 9C.

The mark detection error Err may be given by the following equation:

$$Err=dz\cdot\sin\theta b. \tag{3}$$

Therefore, in order to make the mark detection error Err less than or equal to a target value (target accuracy) T, the following condition should be satisfied:

$$T>dz\cdot\sin\theta b. \tag{4}$$

Accordingly, the mark sensor 110 is configured to satisfy the condition of (4).

Figure 10:
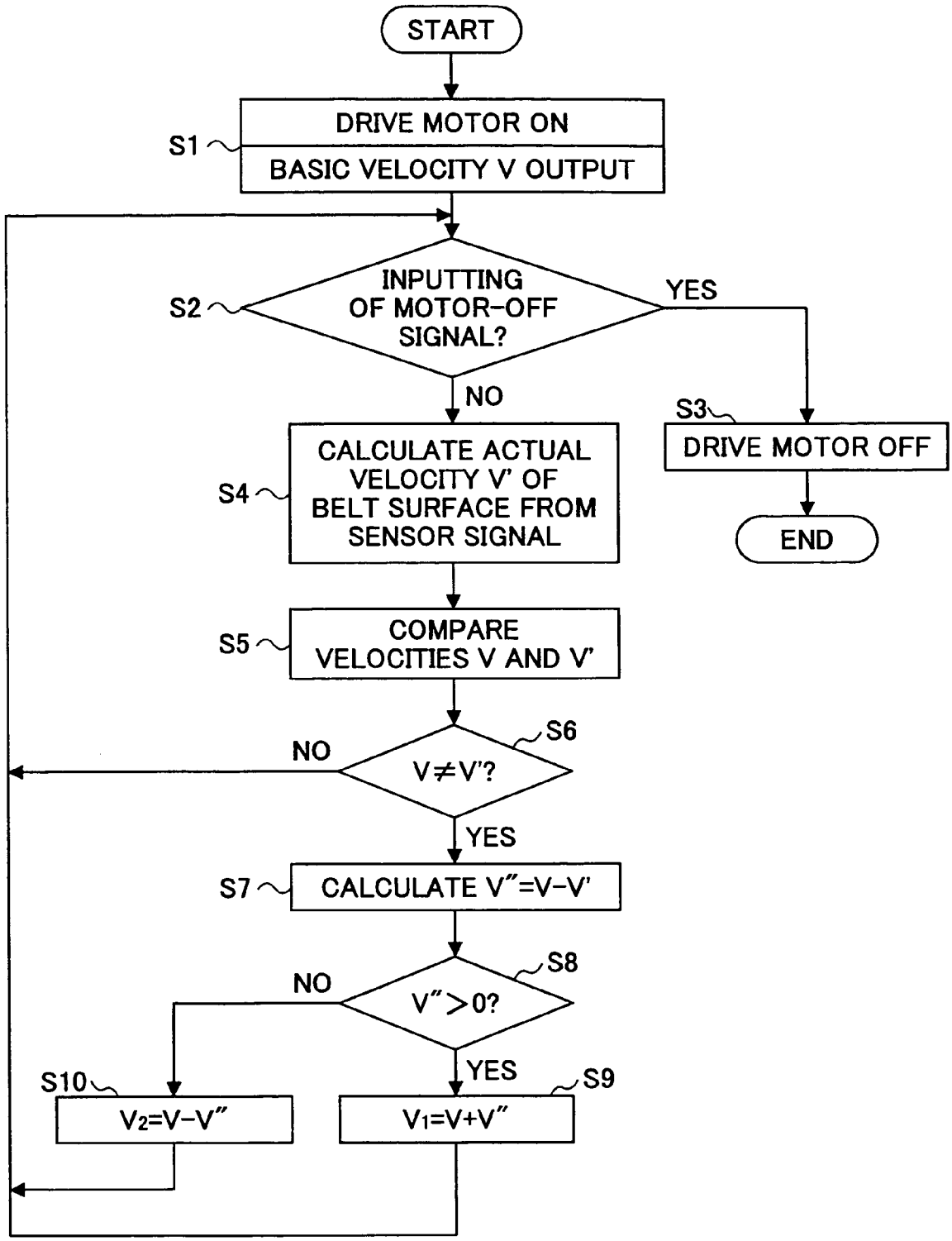
FIG. 10 is a flowchart showing an operation of controlling the velocity of the intermediate transfer belt by a drive controller according to the embodiment of the present invention.

FIG. 10 is a flowchart showing an operation of controlling the velocity of the intermediate transfer belt 25 by the drive controller 100.

When a signal to switch the drive motor 120 ON is fed from a main controller performing overall control of the entire apparatus (not graphically illustrated) to be input to the drive controller 100, the drive controller 100 starts the processing routine of FIG. 10 (at timing to start driving the intermediate transfer belt 25). First, in step S1, the drive controller 100 switches the drive motor 120 ON so that the drive motor 120 rotationally moves the intermediate transfer belt 25 at a basic velocity V that is a target velocity. In step S2, the drive controller 100 determines whether there is inputting of a signal to switch the drive motor 120 OFF from the main controller.

If there is no inputting of a signal to switch the drive motor 120 OFF from the main controller (NO, in step S2), in step S4, the drive controller 100 receives a feedback signal from the mark sensor 110, and calculates the actual velocity V' of the surface (exterior surface) of the intermediate transfer belt 25 from the feedback signal. In step S5, the drive controller 100 compares the calculated actual velocity V' with the basic velocity V, and in step S6, determines whether the basic velocity V and the actual velocity V' are not equal (V≠V'). If the basic velocity V and the actual velocity V' are equal (NO in step S6), the routine returns directly to step S2, and the same determinations and operations as described above are performed.

If the basic velocity V and the actual velocity V' are not equal (YES in step S6), in step S7, the drive controller 100 calculates the difference in velocity between the basic velocity V and the actual velocity V' as a velocity difference V" (V−V'), and in step S8, determines whether the velocity difference V" is greater than zero (V">0).

If the velocity difference V" satisfies V">0 (YES in step S8), it is determined that the actual velocity V' is lower than the basic velocity V. Accordingly, in step S9, the drive controller 100 controls rpm (rotational speed) of the drive motor 120 so that the intermediate transfer belt 25 moves at a velocity $V_1$ that is the sum of the basic velocity V and the velocity difference V" ($V_1$=V+V"). Then, the routine returns to step S2. If the velocity difference V" does not satisfies V">0 (NO in step S8), that is, if V"≦0, it is determined that the actual velocity V" is higher than or equal to the basic velocity V. Accordingly, in step S10, the drive controller 100 controls rpm of the drive motor 120 so that the intermediate transfer belt 25 moves at a velocity $V_2$ that is the difference between the basic velocity V and the velocity difference V" ($V_2$=V−V"). Then, the routine returns to step S2.

Accordingly, by repeating the determinations and operations in and after step S2, the actual velocity V' of the surface of the intermediate transfer belt 25 is corrected and controlled so as to be equal to the basic velocity V.

Thereafter, if the drive controller 100 determines in step S2 that there is inputting of a signal to switch the drive motor 120 OFF from the main controller (YES in step S2), in step S3, the drive controller 100 switches the drive motor 120 OFF, and ends the control operation of FIG. 10.

Thus, according to the color copier of this embodiment, the mark sensor 110 includes a variation prevention part configured to prevent variations of the light illumination surface of the intermediate transfer belt 25 on which surface the scale 250 is formed, and the variation prevention part includes the holding member 300 that holds the intermediate transfer belt 25 in the vicinity of the light illumination surface movably in the moving direction A from the exterior surface side and the interior surface side of the intermediate transfer belt 25. Accordingly, it is possible to reduce detection error in optically detecting the reflection parts (marks) 251 on the scale 250. That is, since the distance between the mark sensor 110 and the light illumination surface (detection distance) is prevented from changing beyond a prescribed range because of the thickness or vibration of the intermediate transfer belt 25, and the attachment angle of the mark sensor 110 is prevented from going beyond a prescribed range at the time of its attachment, the angle between the light illumination surface and the optical axis of a beam emitted from the light emitting element 111 onto the light illumination surface is prevented from going beyond a range that does not affect image quality. As a result, it is possible to reduce detection error due to timing error in mark detection.

Further, the holding member 300 has the short fibers 301 provided on each of a surface thereof opposing the exterior surface of the intermediate transfer belt 25 and a surface thereof opposing the interior surface of the intermediate transfer belt 25. This reduces friction by the holding member 300 at the time of movement of the intermediate transfer belt 25, thus making it possible to reduce the load on a drive part to drive the intermediate transfer belt 25.

Further, the holding member 300 is configured to include the lower holding member (first holding member) 300*a*, holding the surface of the intermediate transfer belt 25 on which the scale 250 is provided, and the upper holding member (second holding member) 300*b*, holding the surface of the intermediate transfer belt 25 on which the scale 250 is not provided. The lower holding member 300*a* is provided on the surface of the sensor housing 302, on which surface the first opening part 304 (for illuminating the light illumination surface through the collimator lens 112 with a beam emitted from the light emitting element 111) and the second opening part 305 (for the light receiving element 115 receiving reflected light from the light illumination surface) are formed, without closing the first and second opening parts 304 and 305. Accordingly, it is possible to detect the marks 251 on the scale 250 with light emission by the light emitting element 111 and light reception by the light receiving element 115.

Further, the second opening part 305 has a larger opening area than the first opening part 304. Therefore, it is possible for the light receiving element 115 to receive the entire reflected light from the light illumination surface even if the detection distance varies.

Further, the sensor housing 302 and the lower holding member 300*a* are disposed below the exterior surface of the intermediate transfer belt 25 on which the scale 250 is formed. The lower holding member 300*a* is configured to be longer than the sensor housing 302 in the moving direction A with the part of the lower holding member 300*a* which part is not in contact with the sensor housing 302 being positioned on the upstream side of the sensor housing 302 in the moving direction A of the intermediate transfer belt 25. The toner trap 306 serving as an opening part for cleaning is formed in the non-contact part of the lower holding member 300*a*. Therefore, even if toner or dust adheres to the scale 250, the toner or dust is removed from the scale 250 by the short fibers 301 of the lower holding member 300*a* before the toner or dust reaches the beam illustration position, and falls down through the toner trap 306. Thereby, it is possible to keep the light illumination surface always clean. Accordingly, it is possible to prevent toner or dust from remaining on the light illumination surface, and thus to avoid wrong detection of the marks 251.

Further, the slit mask 113 having multiple slits for shaping a beam passing through the collimator lens 112 so that the beam has the same width as each reflection part (mark) 251 and illuminating the light illumination surface with the shaped beam is provided in the first opening part 304. Accordingly, it is possible to detect the marks 251 on the scale 250 with accuracy.

Further, the light emitting element 111 and the light receiving element 115 are arranged side by side in the width directions of the intermediate transfer belt 25 perpendicular to the moving direction thereof. Accordingly, it is possible to avoid timing error in mark detection due to variations in the detection distance.

Accordingly, the drive controller 100 can control the velocity or position of the intermediate transfer belt 25 appropriately based on the output of the mark sensor 110, and therefore, can improve image quality.

According to an image forming apparatus according to this embodiment of the present invention, by the use of the above-described belt drive unit, it is possible to perform appropriate image formation, and thus to improve image quality.

Therefore, according to the color copier of this embodiment, including a belt drive unit including the drive controller 100; the intermediate transfer belt 25 having the scale 250 with the marks 251 formed successively at predetermined intervals along the rotational direction A; and the drive motor 120, the gears 121 and 122, and the driving roller 51 for rotating the intermediate transfer belt 25, the drive controller 100 drives and controls the drive motor 120 so that it is possible to control the velocity or position of the intermediate transfer belt 25 through the gears 121 and 122 and the driving roller 51 with accuracy. Accordingly, it is possible to position a toner image of each color on the intermediate transfer belt 25 with high accuracy, and thus to improve image quality.

In the above-described embodiment, the scale 250 having the marks 251 formed successively at equal intervals along the rotational direction A of the intermediate transfer belt 25 is employed. Alternatively, a scale having marks formed successively at predetermined intervals along the rotational direction of an endless belt member other than the intermediate transfer belt 25, such as a paper conveyor belt, a transfer belt, or a photosensitive belt, may also be employed.

Further, in this embodiment, the single mark sensor 110 is used to detect the marks 251 on the scale 250, thereby controlling the velocity or position of the intermediate transfer belt 25. Alternatively, it is also possible to control the velocity or position of an endless belt member such as an intermediate transfer belt by detecting marks on a scale using multiple mark sensors as disclosed in, for example, Japanese Laid-Open Patent Application No. 9-175687. In this case, a mark sensor having the same functions as the above-described mark sensor 110 may be used as each of the multiple mark sensors.

The above description is given of the case where the present invention is applied to a mark sensor (mark detector) for appropriately rotating an endless belt member such as an intermediate transfer belt, a drive controller having the mark sensor, a belt drive unit having the drive controller and the intermediate transfer belt, and a color copier having the belt drive unit. However, the present invention may be applied not only to these, but also to various image forming apparatuses, such as printers, facsimile machines, and multifunctional apparatuses, including the belt drive unit.

A mark detector according to one embodiment of the present invention includes a variation prevention part configured to prevent variations of the light illumination surface of an endless belt member on which surface a scale is formed, and the variation prevention part includes a holding member that holds the endless belt member in the vicinity of the light illumination surface movably in its moving direction from the exterior surface side and the interior surface side of the endless belt member. This configuration makes it possible to reduce detection error in optically detecting multiple marks on the scale. Therefore, it is possible to provide a mark sensor capable of highly accurate mark detection.

Further, according to a drive controller according to one embodiment of the present invention, it is possible to appropriately control the velocity or position of the endless belt member based on the output of the above-described mark detector. Therefore, it is possible to provide a drive controller capable of optimum driving.

Further, according to a belt drive unit according to one embodiment of the present invention, it is possible to move the endless belt member with high accuracy by the control of the above-described drive controller. Therefore, it is possible to provide a belt drive unit capable of optimum belt movement.

According to an image forming apparatus according to one embodiment of the present invention, by the use of the above-described belt drive unit, it is possible to perform appropriate image formation, and thus to improve image quality. Therefore, it is possible to provide an image forming apparatus capable of producing a high-definition image.

The present invention is not limited to the specifically disclosed embodiment, and variations and modifications may be made without departing from the scope of the present invention.

The present application is based on Japanese Priority Patent Application No. 2004-331056, filed on Nov. 15, 2004, the entire contents of which are hereby incorporated by reference.

What is claimed is:

1. A mark detector optically detecting a scale having a plurality of marks formed successively at predetermined intervals along a moving direction of an endless belt member, and outputting an electrical signal corresponding to presence or absence of the marks when the endless belt member moves, the mark detector comprising:

a light illumination part configured to illuminate a light illumination surface of the endless belt member on which surface the scale is formed with parallel light rays;

a light receiving part configured to receive reflected light from the light illumination surface; and a variation prevention part configured to prevent a variation of the light illumination surface, wherein the variation prevention part includes a holding member configured to hold the endless belt member in a vicinity of the light illumination surface movably in the moving direction from an exterior surface side and an interior surface side of the endless belt member.

2. The mark detector as claimed in claim 1, wherein the holding member has cleaning fibers provided on each of a first surface and a second surface thereof, the first surface and the second surface opposing an exterior surface and an interior surface, respectively, of the endless belt member.

3. The mark detector as claimed in claim 1, wherein the holding member comprises a first holding member and a second holding member, the first holding member holding an exterior surface of the endless belt member on which the scale is formed and the second holding member holding an interior surface of the endless belt member on which the scale is not formed;

the light illumination part and the light receiving part are contained in a housing of the mark detector; and the housing has a first opening part for illuminating the light illumination surface with the parallel light rays from the light illumination part and a second opening part for the light receiving part receiving the reflected light from the light illumination surface, with the first holding member being provided, without closing the first and second opening parts, on a surface of the housing on which surface the first and second opening parts are formed in the housing by processing.

4. The mark detector as claimed in claim 3, wherein the second opening part has a larger opening area than the first opening part.

5. The mark detector as claimed in claim 3, wherein the housing and the first holding member are disposed below the endless belt member;

the first holding member is longer than the housing in the moving direction of the endless belt member with a part of the first holding member which part is out of contact with the housing being positioned on an upstream side of the housing in the moving direction; and an opening part for cleaning is formed in the part of the first holding member which part is out of contact with the housing.

6. The mark detector as claimed in claim 3, wherein a slit for shaping the parallel light rays from the light illumination part so that the parallel light rays have a same dimension as a dimension of each mark in the moving direction of the endless belt member and for illuminating the light illumination surface with the shaped parallel light rays is provided in the first opening part.

7. The mark detector as claimed in claim 1, wherein the light illumination part and the light receiving part are arranged side by side in a direction perpendicular to the moving direction of the endless belt member.

8. A drive controller, comprising:

a mark detector as set forth in claim 1, wherein a drive part for rotating the endless belt member is connectable to the drive controller; and the drive controller controls a drive force of the drive part by generating a control signal based on an output of the mark detector, thereby controlling at least one of a velocity and a position of the endless belt member.

9. A belt drive unit, comprising:

a drive controller, the drive controller including a mark detector as set forth in claim 1, wherein a drive part for rotating the endless belt member is connectable to the drive controller, and the drive controller controls a drive force of the drive part by generating a control signal based on an output of the mark detector, thereby controlling at least one of a velocity and a position of the endless belt member;

the endless belt member; and the drive part.

10. An image forming apparatus, comprising:

a belt drive unit, the belt drive unit including:

a drive controller, the drive controller including a mark detector as set forth in claim 1, wherein a drive part for rotating the endless belt member is connectable to the drive controller, and the drive controller controls a drive force of the drive part by generating a control signal based on an output of the mark detector, thereby controlling at least one of a velocity and a position of the endless belt member;

the endless belt member; and the drive part, wherein the endless belt member is one of a paper conveyor belt, a transfer belt, an intermediate transfer belt, and a photosensitive belt.

* * * * *